US005983848A

United States Patent [19]

Calka

[11] Patent Number: 5,983,848

[45] **Date of Patent: *Nov. 16, 1999**

[54] FINGER FOLLOWER

[76] Inventor: Andrzej Calka, 35 Norma Crescent, Ancaster, Ontario, Canada, L9G 4V8

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,309

[22] Filed: Sep. 26, 1997

Related U.S. Application Data

[63] Continuation of application No. 08/524,922, Sep. 8, 1995, abandoned.

[51] Int. Cl.[6] ..... F01L 1/18

[52] U.S. Cl. ..... 123/90.42; 123/90.43; 74/559

[58] Field of Search ..... 123/90.39, 90.4, 123/90.41, 90.42, 90.43, 90.44, 90.45, 90.46; 74/519, 559

[56] References Cited

U.S. PATENT DOCUMENTS

| | | | |
|---|---|---|---|
| 4,614,171 | 9/1986 | Malhotra | 123/90.44 |
| 4,624,223 | 11/1986 | Wherry | 123/90.44 |
| 4,628,874 | 12/1986 | Barlow | 123/90.5 |
| 4,697,473 | 10/1987 | Patel | 74/519 |
| 4,738,231 | 4/1988 | Patel | 123/90.44 |
| 4,796,483 | 1/1989 | Patel | 74/519 |
| 4,825,717 | 5/1989 | Mills | 74/519 |
| 4,872,429 | 10/1989 | Anderson | 123/90.44 |
| 4,940,048 | 7/1990 | Mills | 123/90.39 |
| 4,995,281 | 2/1991 | Allor | 74/559 |
| 5,010,856 | 4/1991 | Ojala | 123/90.36 |
| 5,048,475 | 9/1991 | Mills | 123/90.39 |
| 5,259,346 | 11/1993 | Mills | 123/90.39 |
| 5,544,626 | 8/1996 | Diggs et al. | 123/90.41 |

*Primary Examiner*—Weilun Lo
*Attorney, Agent, or Firm*—Rader, Fishman & Grauer PLLC

[57] ABSTRACT

The invention provides a finger follower body defining a downwardly opening dome at one end, the dome having a seat which is a spherical band having a center and being concentric about a center line. A downwardly facing and downwardly convex valve contact surface is provided at the other end of the follower, and a pair of side walls define openings aligned about an axis. The openings are positioned in the side walls so that a bearing mounted in the openings will be essentially above a first imaginary line drawn between the center of the spherical band and the valve contact surface. The center line converges with another imaginary line drawn through the axis and at right angles to the first imaginary line. A finger follower incorporating the body is also provided.

12 Claims, 2 Drawing Sheets

FINGER FOLLOWER

This is a continuation of U.S. patent application Ser. No. 08/524,922 dated Sep. 8, 1995, now abandoned.

FIELD OF THE INVENTION

This invention relates to finger followers used to transfer rotary motion from an overhead camshaft into reciprocal motion of poppet valves used as inlet and outlet valves in an engine. More particularly, the invention relates to an improved finger follower body for a roller assembly to engage with a cam of an overhead camshaft, the body being compact for improved operation while minimizing energy losses.

BACKGROUND OF THE INVENTION

The present invention is particularly useful in automobiles which use internal combustion engines. Manufacturers of such engines have been concentrating for some time in making them more efficient while at the same time reducing the overall weight to improve the efficiency of the automobile generally. One source of lost energy is the valve train. The weight of the moving parts and the friction they exhibit both work to reduce the efficiency of the engine. More particularly, if the weight can be reduced, then the power lost in accelerating these parts through a cycle will also be reduced. Although some advances have been made, manufacturers still strive for improvement in this area because energy lost in the valve train can not be recovered.

In the past, stamped steel rocker arms have been used instead of heavier forged or cast iron, and it has become common practice to use roller bearings to reduce friction. With the advent of overhead cam systems, there has been a need for arms designed to be supported at one end and to respond to a cam engaging the central section of the arm to deflect the free end into engagement with a valve stem. Such devices are known generally as "finger followers" and this invention is directed to such structures.

Finger followers have developed to the point where it is common practice to mount a central roller bearing to act as a cam follower. The bearing is relatively large and this has caused some design problems resulting from the length of the follower and the need for rigidity despite the weakness created by accommodating the roller bearing.

Examples of state-of-the-art followers are to be found in U.S. patent Ser. Nos. 4,614,171; 4,697,473; 4,872,429; 4,995,281; 5,048,475 and 5,010,856.

Another consideration is the engine head. Overhead valve arrangements result in some complexity in the block due to the fact that hydraulic posts must be accommodated for one end of the finger followers in the general area of the valves themselves. If the posts and valves can be moved closer together, then the amount of material necessary in the engine head can be reduced because there is less material needed to accommodate the parts.

For these and other reasons, a short, light and rigid finger follower would be desirable.

SUMMARY OF THE INVENTION

The present invention relates to a compact finger follower of stamped sheet steel in which a domed recess for receiving a support has been positioned in relation to the roller such that the distance between the lines of action of these parts is reduced. By a similar arrangement, the distance between the line of action of the roller and that of the valve is reduced to produce a compact follower. Because bending moments are reduced, the material of the follower can be lighter, and this combined with the short follower results in a light follower with a relatively small rotational moment of inertia. These factors impinge favourably on energy losses and the compact assembly permits the use of less material in the engine head.

Accordingly, in one of its aspects, the invention provides a compact finger follower body of stamped sheet steel for use in a finger follower for activating a single poppet valve, the body having a pair of upright side walls defining central parallel portions having aligned openings about a second center line to receive a cam follower, a downwardly open dome defining a spherical seat having a center and being concentric about a first center line which on assembly coincides with the center line of a pivot, a first bridge extending transversely between the side walls adjacent the center portions, an upright end wall extending continuously from the center portions about the dome and meeting the first bridge, a first short upright wall extending upwardly from the bridge between the side walls, a second bridge remote from the first bridge with the central portion being between the bridges, a pair of upright reinforcing side walls extending from respective center portions of the side walls and meeting the second bridge, and the underside of the second bridge defining a valve contact surface. The second center line is displaced from an imaginary line drawn between said center of the spherical seat and the contact surface to accommodate the cam follower above the imaginary line.

DETAILED DESCRIPTION OF THE PREFERRED EMBODIMENT

Figure 1:
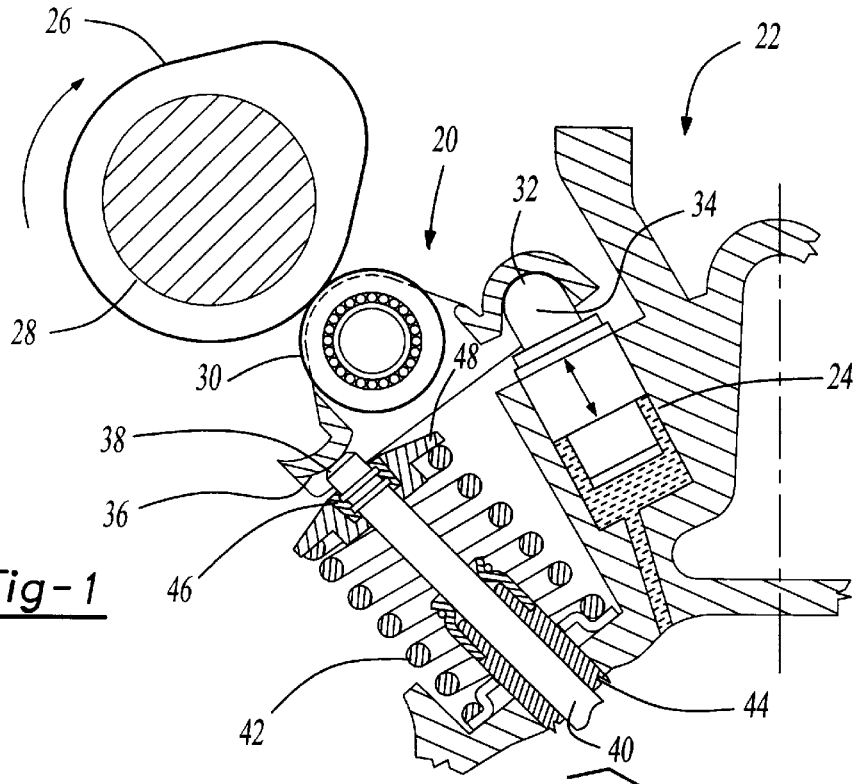
FIG. 1 is a sectional view of a portion of an internal combustion engine showing a finger follower incorporating a preferred embodiment of the invention and assembled to demonstrate the use of the follower to operate a poppet valve.

Reference is first made to FIG. 1 which illustrates a compact finger follower 20 of stamped sheet steel and shown assembled in the cylinder engine head 22 of an exemplary internal combustion engine. The finger follower is in contact at one end with a conventional hydraulic compensator 24 which ensures that there is no play in the assembly, and the follower is operated by a central cam 26 on a camshaft 28 which, when the cam rotates, drives the finger follower by engagement with a cam follower 30. This results in pivotal movement about a hemispherical pivot 32 on the end of a plunger 34 associated with the compensator 24. The rotational movement initiated by the cam causes a downwardly convex valve contact surface 36 at the other end of the follower remote from the pivot to push on an end 38 of a conventional poppet valve 40 which is biased outwardly by a compression spring 42.

The hydraulic compensator 24 is conventional in the art and it is not uncommon to use hemispherical pivot 32 in engagement with the finger follower. Similarly, the valve 40 is conventional and sits in a guide 44 held in place by split collets 46 engaged in a retainer 48 to contain the compression spring 42 and to maintain a restoring force on the valve 40 to seat the valve when it is not actuated by the finger follower.

Figure 2:
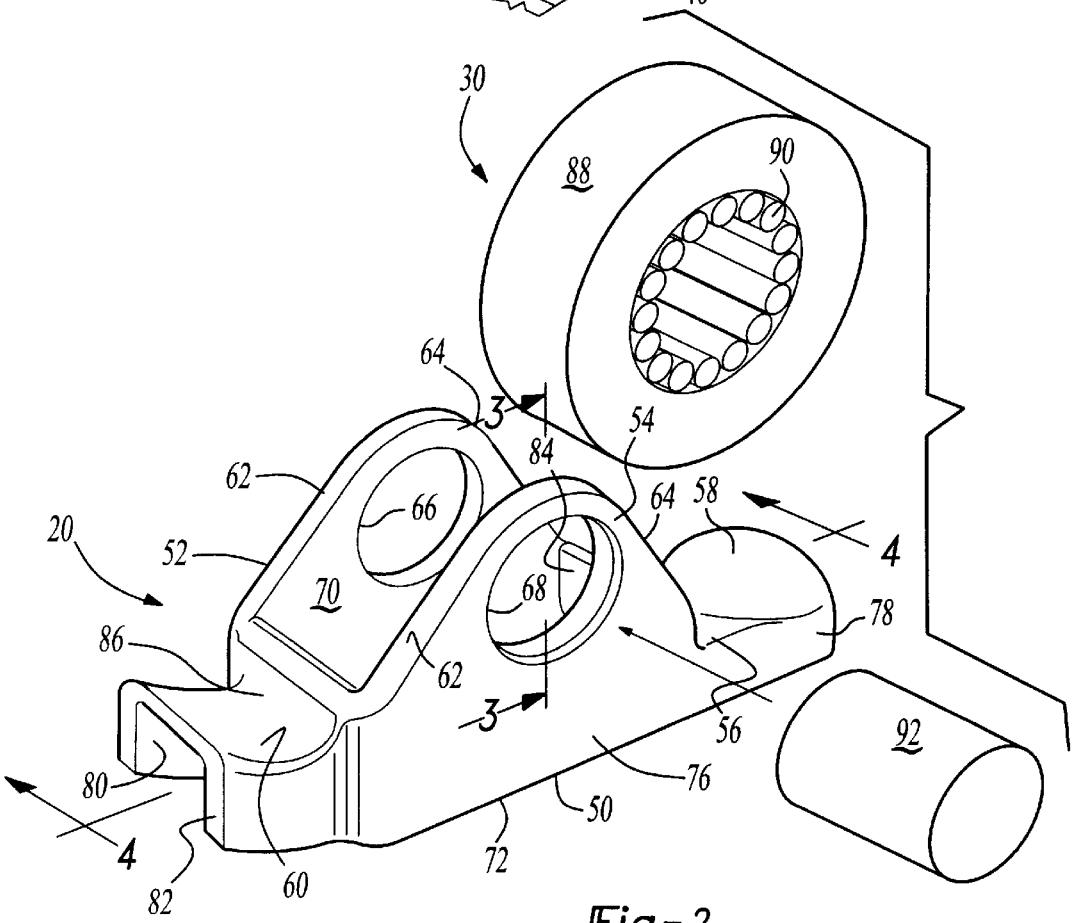
FIG. 2 is an exploded perspective view of the finger follower shown in FIG. 1 and drawn to a larger scale.

Details of the structure of the follower 20 are better seen in FIG. 2. The finger follower includes a body 50 made up essentially of a pair of upright side walls 52, 54, a transverse first bridge 56 adjacent a dome 58, and a transverse second bridge 60 at an opposite end of the follower from the first bridge 56.

The side walls 52, 54 define respective convergent upper edges 62, 64 which converge about respective aligned openings 66, 68. This arrangement gives the center portions 70, 72 of the side walls a generally triangular appearance with the openings 66, 68 being above continuous lower portions 74, (better seen in FIG. 4) and 76 of the center portions, 70, 72. The continuous lower portions extend into a continuous upright low end wall 78 which meets the first bridge 56 and is continuous around the integral dome 58. At the other end of the follower, the lower portions 74, 76 extend into upright reinforcing side walls 80, 82 which are attached to ends of the second bridge 60. As better seen in FIG. 4, the respective bridges 56 and 60 continue into respective short upright walls 84, 86 extending from the center portions 70, 72 seen in FIG. 2 to rigidify the structure. The upward extent of these walls is limited by the space needed to accommodate the cam follower 30.

As a result of the structure described, the main body has a deep cross section in alignment with the openings 66, 68 to provide rigidity, and the bridges 56, 60 and associated short upright walls 84, 86 rigidify the structure at the ends of the central portions of the side walls. This provides rigidity to withstand the loading applied to the finger follower as will be described more fully with reference to FIG. 4.

Figure 3:
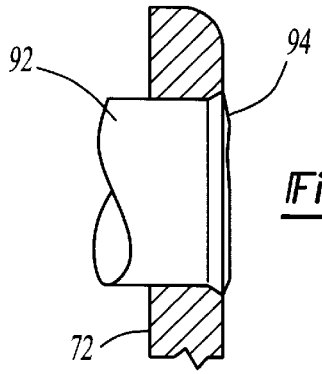
FIG. 3 is a sectional view on line 3—3 of FIG. 2 after assembly of the finger follower.

The assembly of the follower can be seen from the illustration in FIG. 2. The cam follower 30 consists of an outer race 88 containing needle bearings 90 for rolling engagement with a surface of a hardened shaft 92. The outer race 88 along with the needle bearings 90 is first positioned between the center portions 70, 72 and aligned with the openings 66, 68 to receive the shaft 92. The shaft is a sliding fit within the openings and is held in place in the manner shown in FIG. 3. Here it will be seen that an end of the shaft (which is typical of both ends) has been deformed radially outwardly as illustrated at 94. This outward deformation is accommodated in a chamfer 96 better seen in FIG. 3. The assembly is then ready to be placed in an engine in the fashion shown in FIG. 1.

Figure 4:
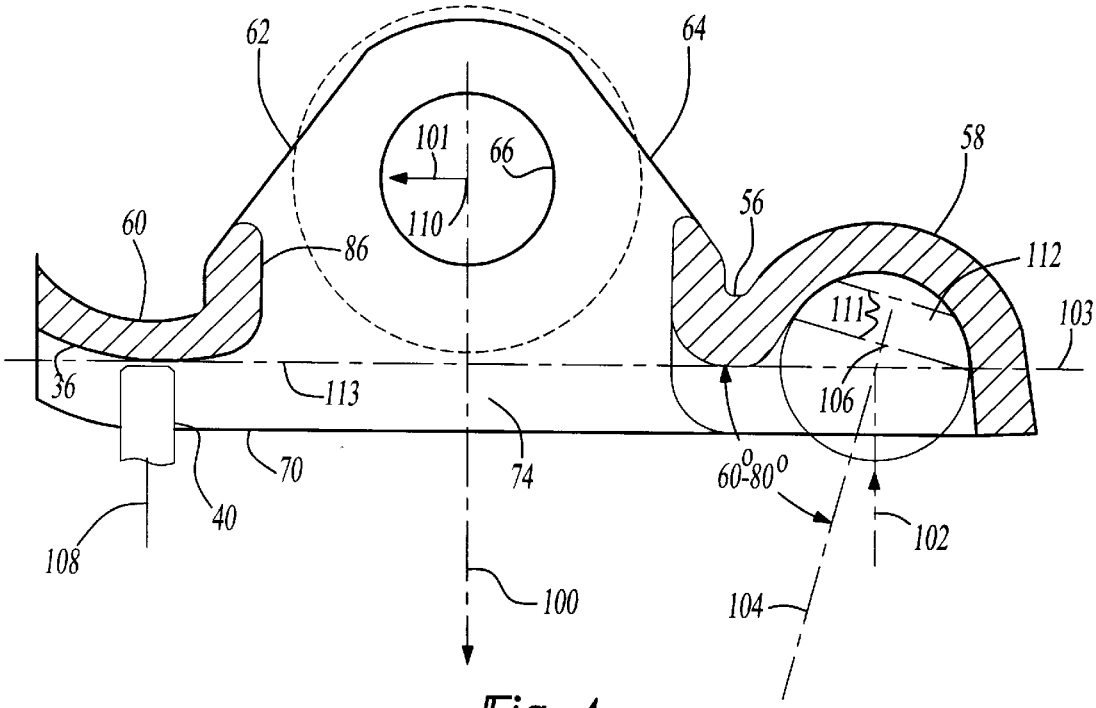
FIG. 4 is a sectional view on line 4—4 of FIG. 2 of a finger follower body according to the invention and drawn to demonstrate the geometrical relationships of portions of the body.

Reference is made to FIGS. 1 and 4 to describe the action of the follower in use, and the forces applied to the follower.

Consider first of all momentary bending stresses caused by applied loads. When the cam 26 pushes down on the cam follower 30, the finger follower is made to rotate about the pivot 32 with the cam force being applied instantaneously with a component acting essentially downwards along a line indicated by the chain-dotted line 100 and the reactive force along a chain-dotted line 102. Because the cam is moving clockwise as drawn, there will be a component of force attempting to sweep the finger follower to the left in the direction of arrow 101 and this will be resisted by a reactive load in the dome 58 and indicated by arrow 103. The net result in the dome is a force generally along a line 104 which is the center line of the plunger 34. Clearly this is desirable in order to minimize side forces on the cantilevered plunger.

The bending stresses will be reduced if the distance between the lines 100 and 102 is as small as possible. This is because as the cam 26 causes rotation of the finger follower, the valve provides a resistive force along a line of action 108. In effect, the valve and pivot support the finger follower while the cam attempts to deform it by pressing downwardly between the two supports.

Again, the distances between the lines 108 and 100, and between 100 and 102, should be minimized. This has been achieved by offsetting the axis or center line 110 of openings 66, 68 with respect to a line drawn between the pivot center 106 and the valve contact surface 36. This is a vertical offset so that the full diametric extent of the outer roller race 88 (FIGS. 2 and 4) is moved away from the line 113 between pivot center 106 and surface 36 to allow the center 106 to be nearer the surface 36. Consequently the lines 108, 102 can be brought closer together. Also, because the plunger 34 (FIG. 1) lies on line 104, which is angled to converge with the line 100, the dome can provide proper seating to withstand the component of force on line 101 at the center 110. The angle between the center line of the valve 108 and the plunger center line 104 is preferably in the range 60 to 80 degrees with the optimum angle about 70 degrees.

As seen in FIG. 4, the seat for the spherical end of the plunger is effectively a sectional band 112 through a sphere and shown by parallel chain-dotted lines 111 within the dome. The band 112 is symmetrical about the line 104. Above the lines 111, the dome has a shorter radius to provide clearance with the spherical end of the plunger to provide an oil reservoir fed through the plunger. Of course this could be changed and the band could be defined as a dome above one of the lines 111.

Relief from the reservoir in the dome above the pivot can be provided as desired by providing holes or grooves in the interior surface of the dome or through the wall of the dome. With this arrangement, as the finger follower rotates about the center 106, the follower will move rotationally about the center 106 providing some longitudinal movement as the valve is depressed. This longitudinal movement is accommodated by the curved contact surface 36 which minimizes sliding over the end 38 (FIG. 1) of the valve.

In summary, the combination of separation between the center 110 and an imaginary line 113 drawn between the contact surface 36 and the center 106 is combined with the rotational position of the seat in the dome to result in a reduced distance between the lines 100 and 102 and convergence between imaginary line 100 drawn at right angles to line 113 and the center line 104. The shorter follower allows for lighter sections since the bending moments are reduced.

Turning now to the rotational moment of inertia of the finger follower. It is well understood that the force required to cause rotational acceleration is dependent upon the moment of inertia as well as on the acceleration required. In general, several factors reduce the forces used to move a follower. Firstly, if the follower is light, it will have a reduced moment of inertia. However, rigidity will suffer if the follower is too light. It is therefore necessary not only to lighten the follower, but also to meet the rigidity requirements. Consequently, the follower has to be shorter so that the bending moments applied are reduced and so that the amount of material used in the follower can be reduced without unduly weakening the follower. It is therefore evident that reduced length is of great significance.

Another approach to reducing weight is to reduce the width of the follower to minimize undue use of material.

This has been achieved by the use of flat surfaces on the inside of the center portions 70, 72 (FIGS. 2 and 4) free of inwardly facing lips and edges which would effectively increase the width of the follower. As a result the width is dictated only by the necessary depth of the outer race 88 (FIG. 2) and the thicknesses of the center portions 70, 72 (plus of course a small amount of clearance). This arrangement is made possible because the openings 66, 68 for the bearing shaft 92 are offset leaving the uninterrupted continuous lower portions 74, 76 to provide material in the cross-section taken vertically through the center 110.

The invention can be varied in detail within the scope of the invention. Such variations are included in the claims.

I claim:

1. A compact finger follower for use in an engine having an overhead camshaft, the finger follower comprising:

a body with first and second ends and having a pair of side walls including parallel center portions that define a width of the finger follower;

first and second bridge portions extending transversely between the side walls wherein the center portions are located between the first and second bridges;

a dome located adjacent the first bridge and including a seat therein for engaging a plunger, the seat being defined by a center point;

an upright end wall extending continuously from the center portions about the dome and meeting the first bridge;

a downwardly convex valve contact surface located on the underside of the second bridge for engaging an end of a valve;

a cam follower having an outermost surface and being mounted between the center portions of the side walls about a first transverse center line for receiving a load from a cam; and wherein the full diametric extent of the outermost surface of the cam follower is located above an imaginary line drawn between the center point of the seat and the lowermost extremity of the valve contact surface to allow the center point to be positioned closer to the valve contact surface.

2. The finger follower of claim 1, wherein the seat includes a sectional band of a sphere defined by a pair of spaced apart parallel lines.

3. The finger follower of claim 2, further including a dome portion located above the sectional band and having a smaller radius than the radius of the sphere to provide an oil reservoir.

4. The finger follower of claim 1, wherein the cam follower includes a roller bearing.

5. The finger follower of claim 4, wherein the center portions of the side walls define respective aligned openings in which the bearing includes a shaft mounted in the openings.

6. The finger follower of claim 5, wherein the aligned openings further include outwardly facing chamfers and in which the shafts are deformed outwardly into permanent engagement with the chamfers to lock the shaft in the body.

7. The finger follower of claim 1, further including a relatively short upright wall adjacent the dome and extending upwardly from the first bridge between the side walls to increase rigidity.

8. A compact finger follower for use in an engine having an overhead camshaft, the finger follower comprising:

a body with first and second ends and having a pair of side walls including parallel center portions that define a width of the finger follower;

first and second bridge portions extending transversely between the side walls wherein the center portions are located between the first and second bridges;

a dome located adjacent the first bridge and including a seat therein for engaging a plunger;

the seat being defined by a predetermined band of a sphere having a center point, the band being oriented symmetrically about a first center line;

an upright end wall extending continuously from the center portions about the dome and meeting the first bridge;

a downwardly convex valve contact surface located on the underside of the second bridge for engaging an end of a valve;

a cam follower having an outermost surface and being mounted between the center portions of the side walls about a second center line for receiving a load from a cam;

wherein the full diametric extent of the outermost surface of the cam follower is located above an imaginary line drawn between the center point of the seat and the lowermost extremity of the valve contact surface to allow the center point to be positioned closer to the valve contact surface; and wherein the first center line is inclined at an angle of about 60 to 80 degrees relative to the imaginary line.

9. The finger follower of claim 8, wherein the predetermined band is a sectional band of a sphere defined by a pair of spaced apart parallel lines.

10. The finger follower of claim 9, further including a dome portion located above the sectional band and having a smaller radius than the radius of the sphere to provide an oil reservoir.

11. The finger follower of claim 8, further including a relatively short upright wall adjacent the dome and extending upwardly from the first bridge between the side walls to increase rigidity.

12. The finger follower of claim 8, wherein the angle between the first center line and the imaginary line is approximately 70 degrees.

* * * * *